US007513179B2

(12) United States Patent
Wilson, Jr.

(10) Patent No.: US 7,513,179 B2
(45) Date of Patent: Apr. 7, 2009

(54) DRIVE ENGAGEMENT, SAFETY AND CONTROL APPARATUS FOR A POWERED CONNECTOR DRIVER

(75) Inventor: David Wilson, Jr., Fort Collins, CO (US)

(73) Assignee: American Power Tools Company, Wellington, CO (US)

( * ) Notice: Subject to any disclaimer, the term of this patent is extended or adjusted under 35 U.S.C. 154(b) by 0 days.

(21) Appl. No.: 12/004,757

(22) Filed: Dec. 21, 2007

(65) Prior Publication Data

US 2008/0134841 A1 Jun. 12, 2008

Related U.S. Application Data

(63) Continuation of application No. 11/634,695, filed on Dec. 6, 2006, now Pat. No. 7,311,025.

(51) Int. Cl.
*B25B 23/145* (2006.01)
*B25B 23/147* (2006.01)
*B25B 21/00* (2006.01)

(52) U.S. Cl. ..... 81/429; 81/467; 81/57.13

(58) Field of Classification Search ..... 81/429, 81/467, 57–57.14, 58.2, 57.28–57.34
See application file for complete search history.

(56) References Cited

U.S. PATENT DOCUMENTS 2,854,755 A 10/1958 Knobel
2,995,738 A 8/1961 Masek
3,289,310 A 12/1966 Stone
3,581,607 A 6/1971 Rogers
3,724,964 A 4/1973 Needham, Jr.
4,095,325 A 6/1978 Hashimoto et al.
4,330,052 A 5/1982 Schymick
4,335,516 A 6/1982 Edelstein
4,376,396 A * 3/1983 Hayhoe ..... 81/57.14
4,909,683 A 3/1990 Kopidlowski et al.
5,355,751 A * 10/1994 Specht ..... 81/57.14
5,460,062 A 10/1995 Wilson, Jr.
5,522,285 A * 6/1996 Wilson et al. ..... 81/57.14
5,537,897 A 7/1996 Wilson, Jr.
5,609,077 A 3/1997 Ohmi et al.
5,881,612 A * 3/1999 McCallops et al. ..... 81/58.2
7,311,025 B1 * 12/2007 Wilson, Jr. ..... 81/429

* cited by examiner

*Primary Examiner*—David B Thomas
(74) *Attorney, Agent, or Firm*—Harold A. Burdick

(57) ABSTRACT

A powered driver and methods are disclosed, the driver including a head having a gapped jaw and housing a motor driven drive transfer assembly for operating a rotatable split socket engageable at a threaded connector. A reaction unit having a biased fitting engagement attached to rail guides is movably maintained through the head, and a probe and switch are associated with different ones of the reaction unit and the head. A safety assembly includes a biased gate switch engageble with a roller switch and is located at the head for sending run status electrical signals to the driver dependent on position of the gate switch. Control lights and switches are provided for user interface and driver status monitoring.

19 Claims, 14 Drawing Sheets

DRIVE ENGAGEMENT, SAFETY AND CONTROL APPARATUS FOR A POWERED CONNECTOR DRIVER

RELATED APPLICATION

This Application is a Continuation Application of U.S. patent application Ser. No. 11/634,695 filed on Dec. 6, 2006 by David Wilson, Jr., and entitled "Powered Driver With Location Specific Switching", now U.S. Pat. No. 7,311,025.

FIELD OF THE INVENTION

This invention relates to drivers for tools, and, more particularly, relates to powered nut drivers.

BACKGROUND OF THE INVENTION

Powered drivers, both pneumatic and electrical, for manipulation of various types of tools such as sockets for threaded connectors are well known. In many applications, such as manipulation of threaded line fittings (i.e., unions or the like) found in all gas or liquid processing or delivery operations and assemblies, the tightness of the fitting is critical to assure a sound connection and to avoid leakage (which may occur if line fittings are either over or under tightened).

Numerous approaches to gauging the correct tightness of such connectors have been heretofore suggested and/or utilized, with varying degrees of success. Torque requirements for driving large and small fasteners vary such that the same driver often cannot be employed for different fasteners. Moreover, devices and methods for gauging fitting integrity during fitting installation that are used for pneumatic tools are frequently not applicable for electrical drivers and vice versa. Such heretofore known approaches are often not highly accurate and repeatable, and/or are quite expensive computer-based applications of limited utility in the field. Further improvement of such drivers and driving methods could thus still be utilized.

SUMMARY OF THE INVENTION

This invention relates to improved drivers and methods for manipulating threaded connectors that accommodate repeated precise tightening of threaded connectors based on location specific switching. In particular drive engagement, safety and control apparatus for a powered connector driver utilized to rotate a threaded fitting are provided by the invention of this application. A driver head having a gapped jaw is receivable at the driver and includes means for effecting rotation of a split socket maintained therein to selectively rotate the threaded fitting when received in the split socket through the gapped jaw. A safety assembly is provided including a status indicating control light and a biased gate switch pivotably connected at the driver head and biased to a position normally closing access through the gapped jaw. The gate switch has a geometry selected so that a fitting presented thereat causes pivoting movement of the gate switch against bias to allow fitting access through the gapped jaw and into the split socket. The control light, responsive to the gate switch, indicates to a user when the gate switch has been pivoted against bias allowing fitting receipt at the split socket.

A second (preferably a roller) switch is engageble by the gate switch and sends run status electrical signal to the driver controller dependent on position of the gate switch. Operational switches are provided at the driver and include a main on/off switch, an operational drive switch (or trigger), and a jog switch for user advancement or reversal of rotation in small increments. The operational switches are connected with the controller.

The driver is capable of application over a wide variety of fastener types, independent of torque requirements and/or fastener size. The engagement, safety and control apparatus, drivers and methods are appropriate for both pneumatic and electrical applications. Specified fastener tightening using the drivers and methods of this invention is highly accurate and repeatable, while yet maintaining a cost effective and safe tool for both manufacturing and field applications.

It is therefore an object of this invention to provide improved drive engagement, safety and control apparatus for threaded connector drivers.

It is another object of this invention to provide drive engagement, safety and control apparatus for line fitting drivers that safely accommodate repeated precise tightening of threaded connectors.

It is still another object of this invention to provide drive engagement, safety and control apparatus for threaded connector drivers utilizing a split socket that safely automate aspects of driver control.

It is yet another object of this invention to provide drive engagement and safety apparatus for a powered connector driver utilized to rotate a threaded fitting, the apparatus including a driver head receivable at the driver and having a gapped jaw and means for effecting rotation of a split socket maintained therein to selectively rotate the threaded fitting when received in the split socket through the gapped jaw of the driver head, and a safety assembly including status indicating control light and a biased gate switch pivotably connected at the driver head and biased to a position normally closing access through the gapped jaw, the biased gate switch having a geometry selected so that a fitting presented thereat causes pivoting movement of the gate switch against bias to allow fitting access through the gapped jaw and into the split socket, the control light at least responsive to the biased gate switch for indicating to a user when the gate switch has been pivoted against bias allowing fitting receipt at the split socket.

It is still another object of this invention to provide drive engagement and safety apparatus for a powered connector driver having user controls utilized to rotate a threaded fitting, the apparatus including a driver head receivable at the driver and having a gapped jaw, a drive translate assembly for altering plane of rotation of the driver and means for effecting rotation of a split socket maintained therein to selectively rotate the threaded fitting when received in the split socket through the gapped jaw of the driver head, and a safety assembly including a biased first switch and a second swatch engageble by the first switch, the first switch pivotably connected at the driver head, biased to a position normally closing access through the gapped jaw and having a geometry selected so that a fitting presented thereat causes pivoting movement of the first switch against bias to allow fitting access through the gapped jaw and into the split socket, the second switch sending run status electrical signals to the driver dependent on position of the first switch.

It is another object of this invention to provide control and safety apparatus for a powered connector driver having a driver head with a gapped jaw and means for effecting rotation of a split socket maintained therein to selectively rotate a threaded fitting when received in the split socket through the gapped jaw of the driver head, the apparatus including a operational switches at the driver including a main on/off switch, an operational drive switch, and a jog switch for user advancement or reversal of rotation in small increments, the operational switches connected with a controller, and a safety assembly associated with the controller and including a biased switch pivotably connected at the driver head and biased to a position normally closing access through the gapped jaw, the biased gate switch having a geometry selected so that a fitting presented thereat causes pivoting movement of the biased switch against bias to allow fitting access through the gapped jaw and into the split socket, user activation of the drive switch being thereby enabled by the controller.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
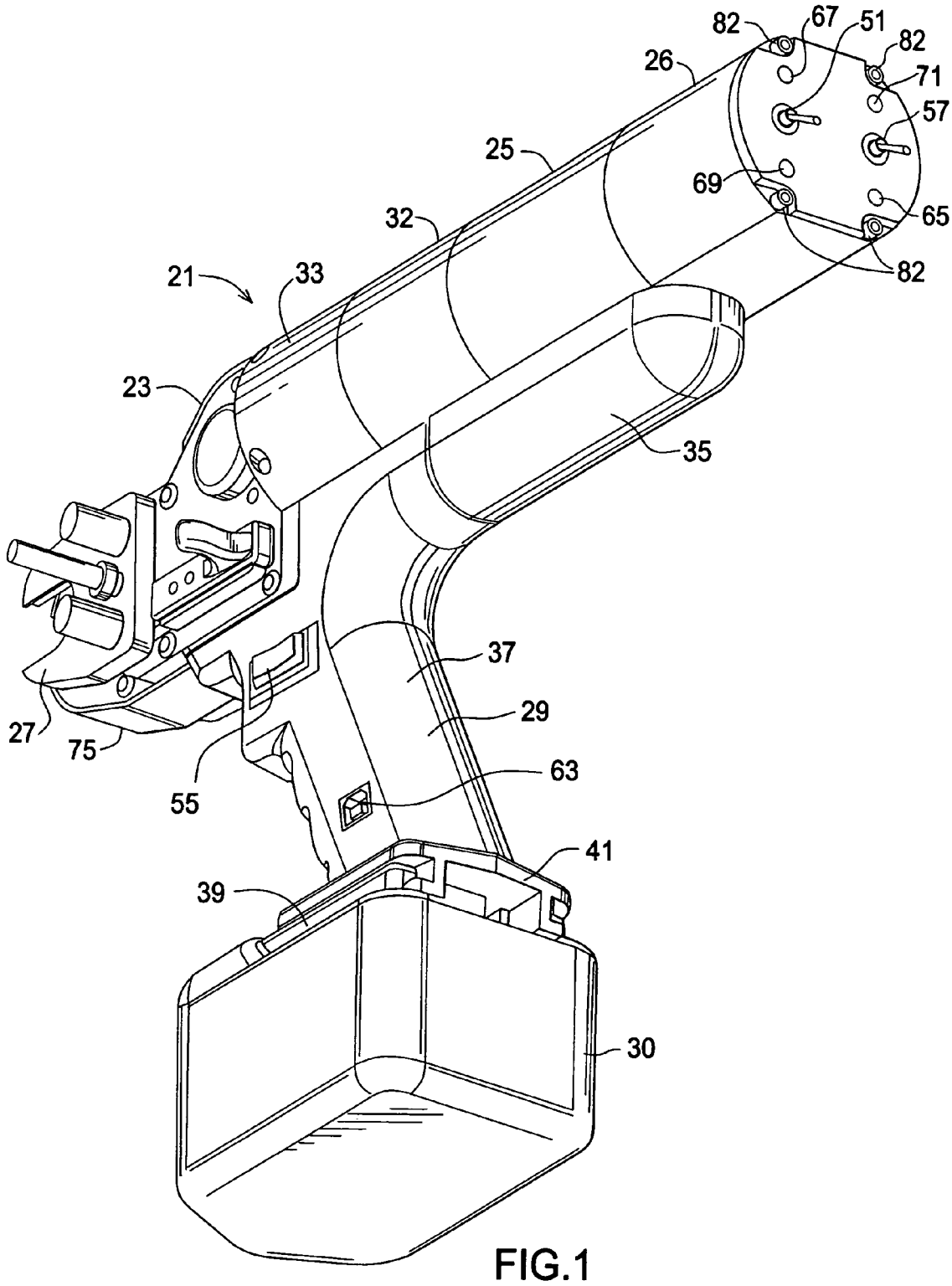
FIG. 1 is a perspective view showing the tool driver of this invention.
Figure 2:
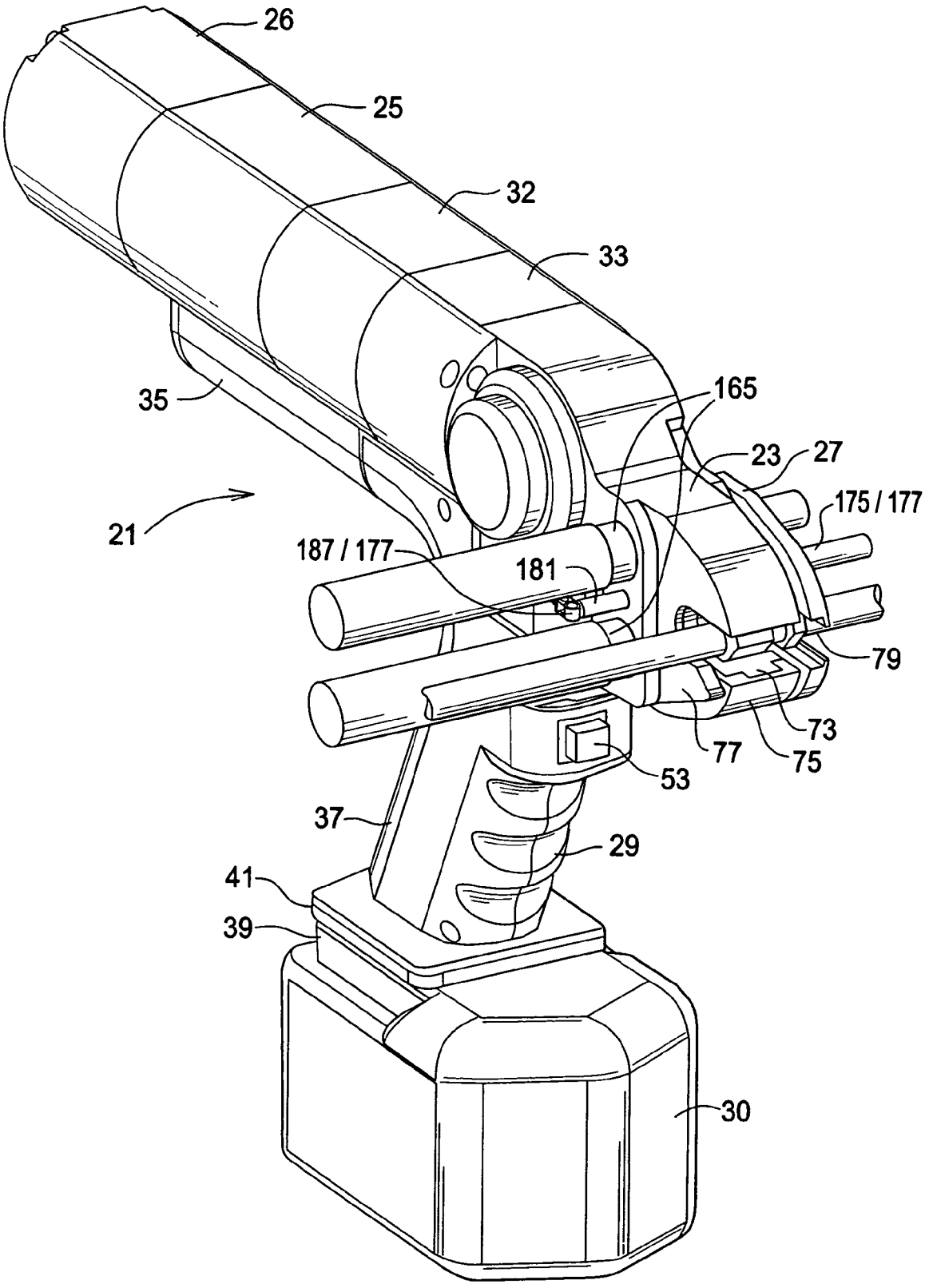
FIG. 2 is a reverse perspective view of the driver of FIG. 1.
Figure 3:
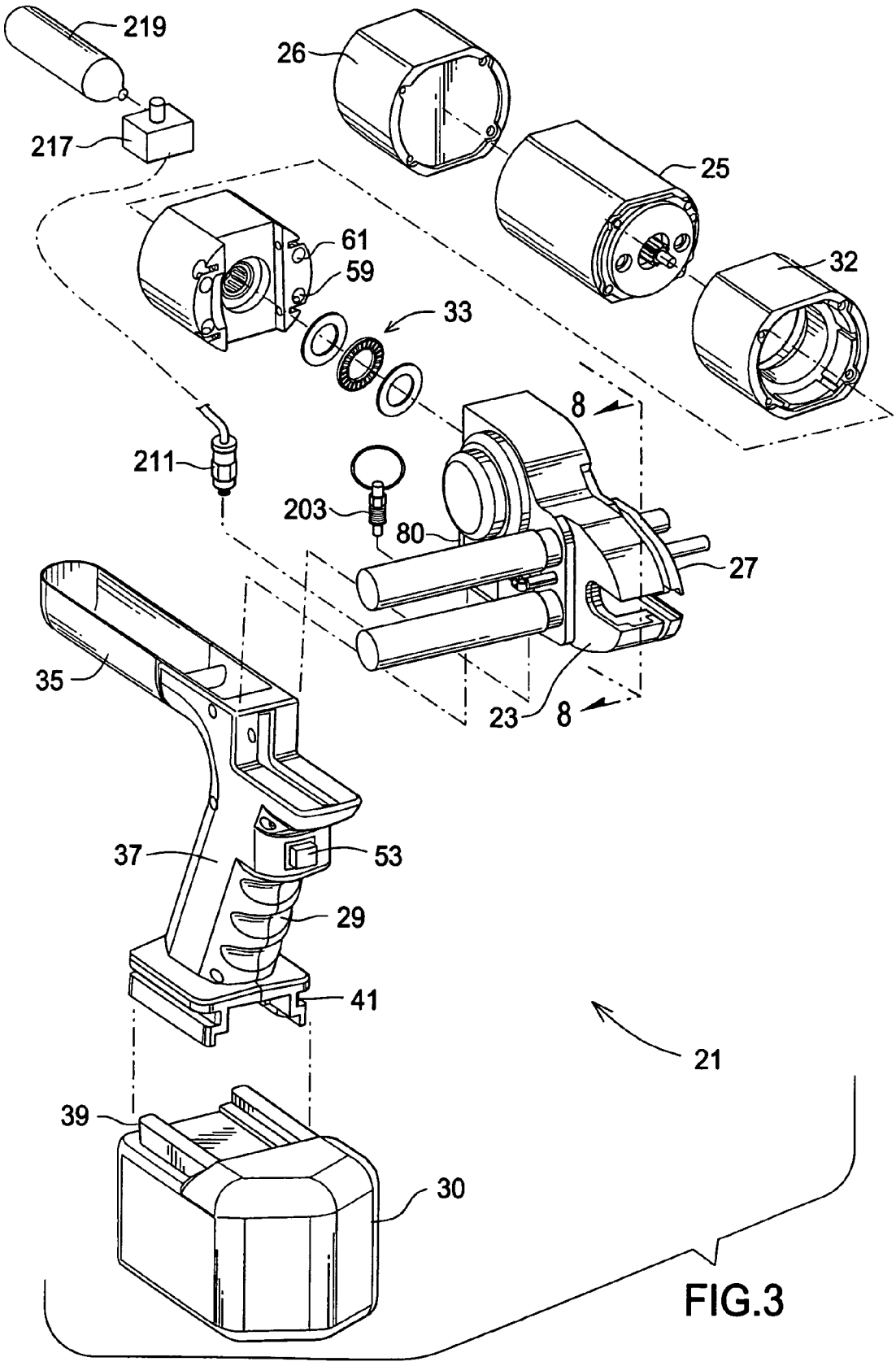
FIG. 3 is a partial exploded view of the housing and components of the driver of this invention.

Powered driver 21, for rotating tools such as sockets or the like to manipulate threaded connectors, is illustrated in FIGS. 1 through 3. Driver 21 includes driver head 23, motor module 25 (any means of applying motive force could be used including electrical, pneumatic or fluid drive motors), electronics module 26, reaction unit 27, housing 29, and battery pack 30. Torque amplification drive train modules 32 and 33 provide a drive train capable of staged increase of torque from a motor 25 rating of about 0.18 ft·lbs. to over 35 ft·lbs., thereby accommodating connector manipulation in a wide variety of size and torque application categories (torque amplification is adaptable to requirements). Housing 29 is hollow at both barrel portion 35 and handle portion 37 thus providing the required space and protection for driver electrical components as hereinafter discussed. Battery pack 30 is of standard configuration and includes a standard conductive slide connector 39 (with mating unit 41 at handle portion 35) providing both connectivity and security of batteries in pack 30.

Figure 4:
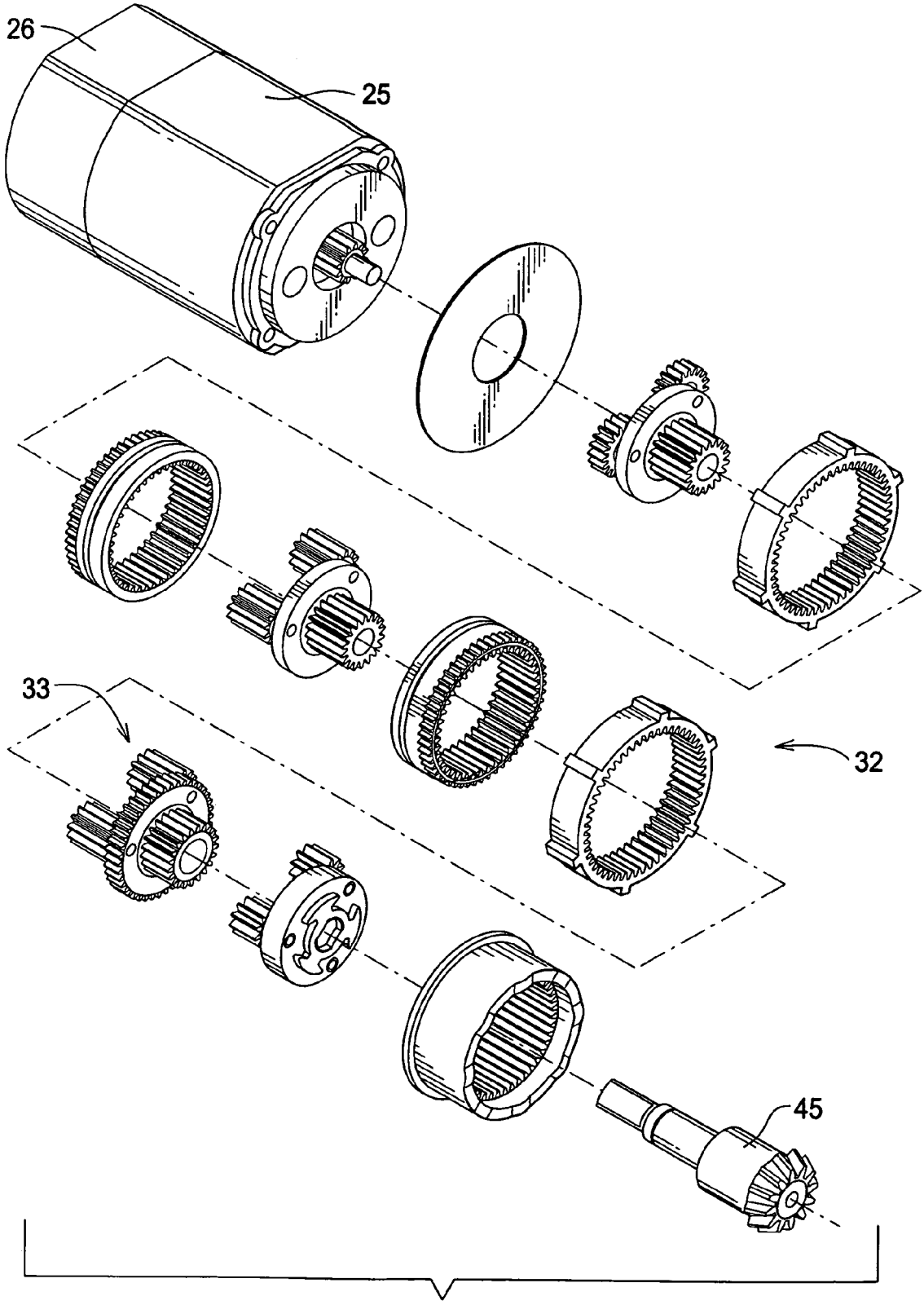
FIG. 4 a detailed exploded view of housed drive train elements not shown in FIG. 3.
Figure 5:
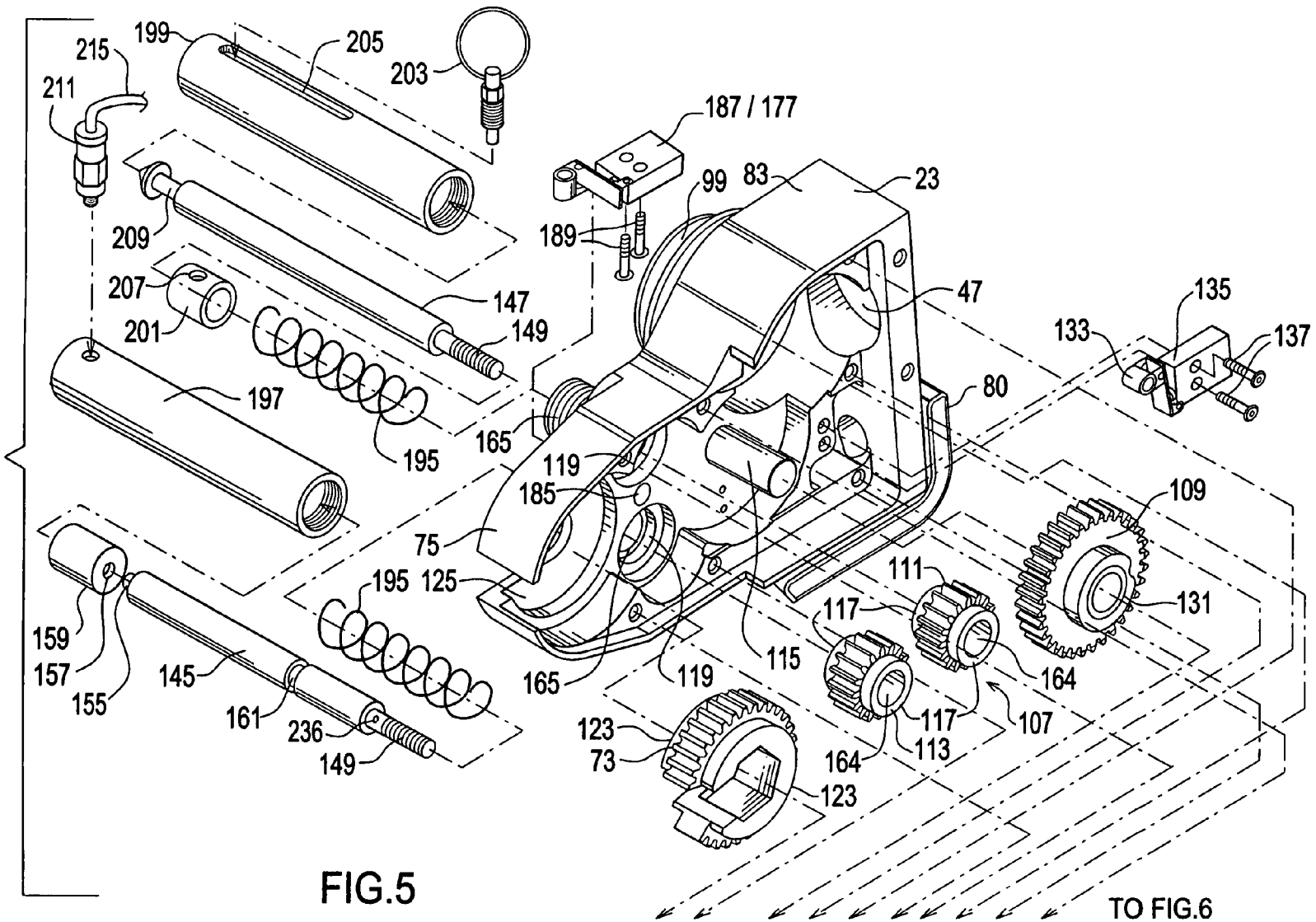
FIG. 5 is a partial exploded view of the driver head of the driver of this invention.
Figure 6:
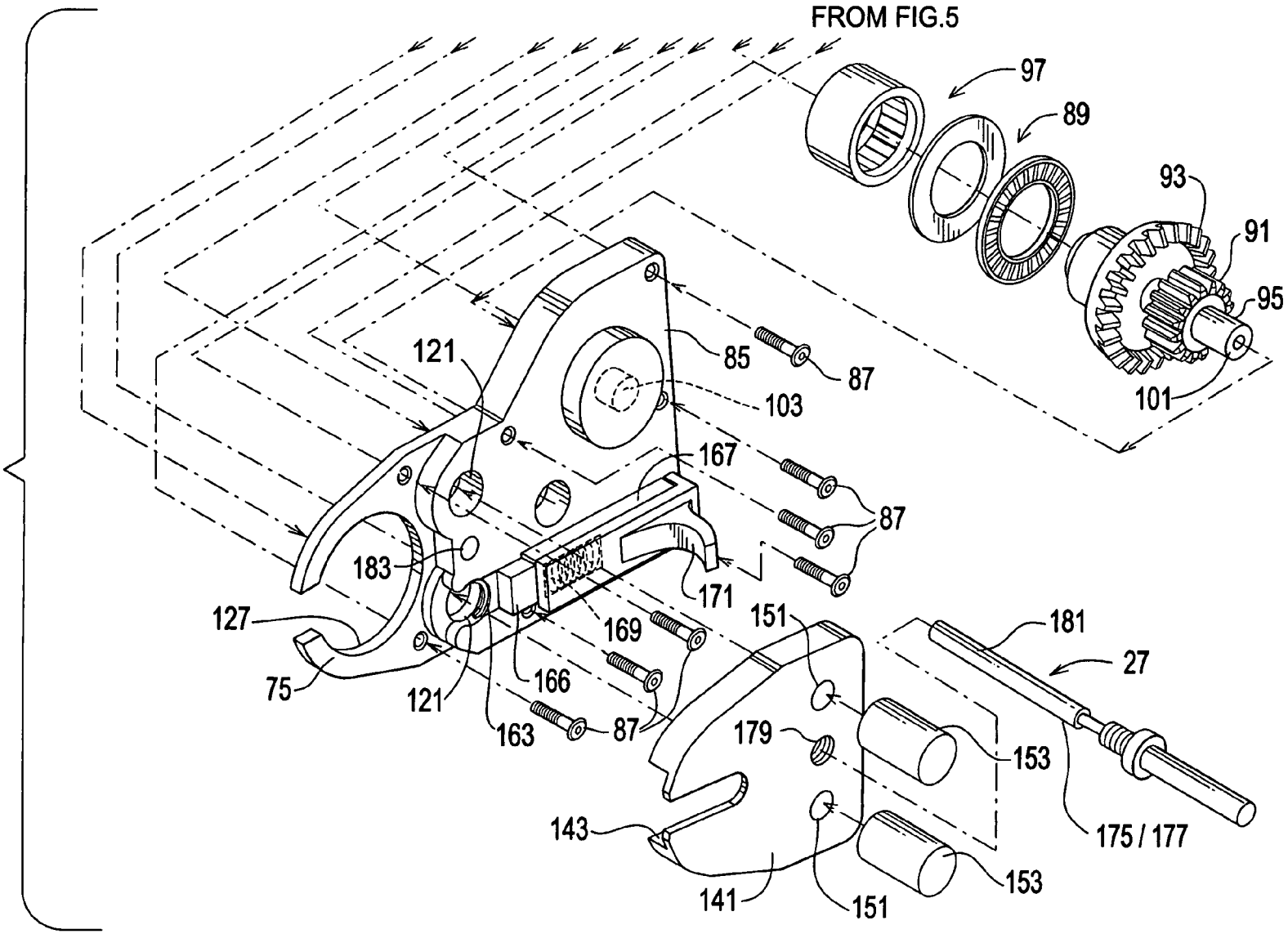
FIG. 6 is a second partial exploded view of the head of the driver of this invention.
Figure 7:
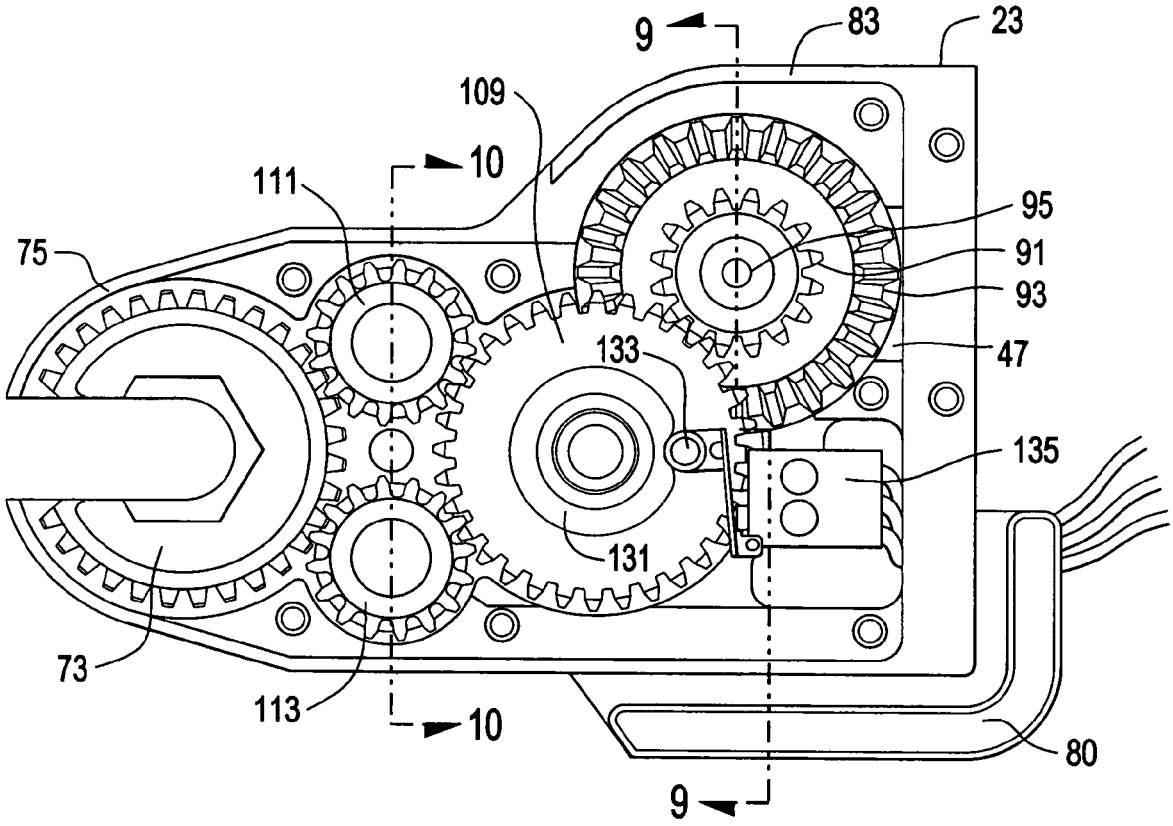
FIG. 7 an elevation view of the head of the driver of this invention with the top cover removed.
Figure 8:
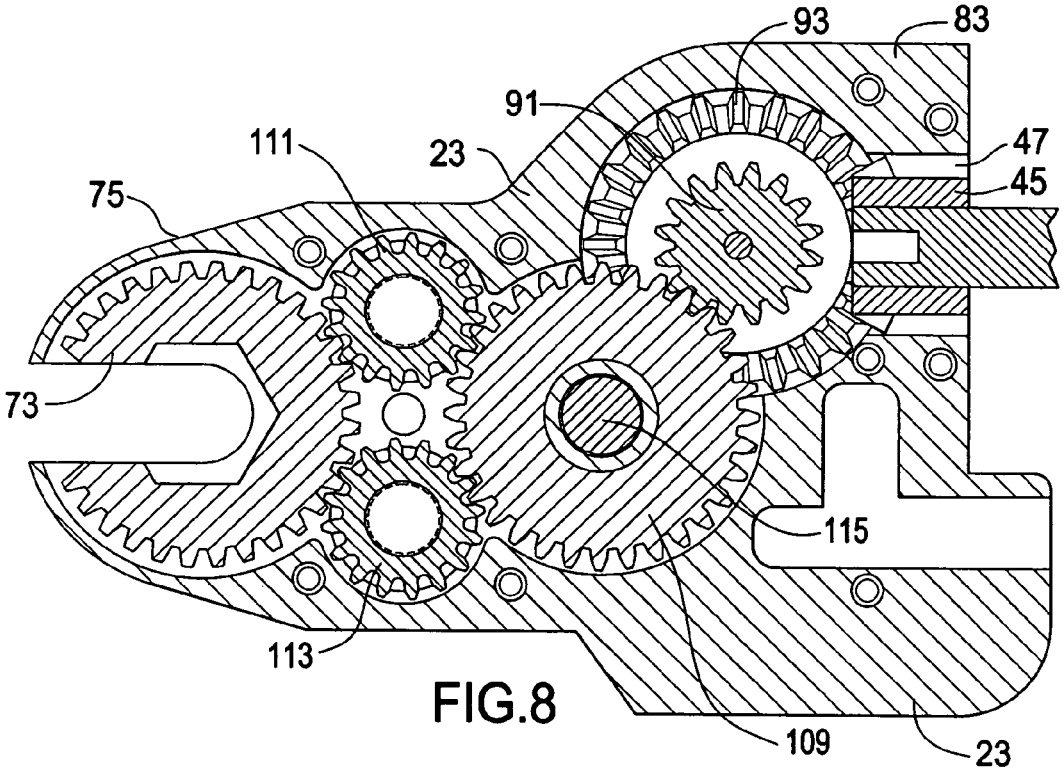
FIG. 8 is a sectional view taken along section lines 8-8 of FIG. 3.
Figure 9:
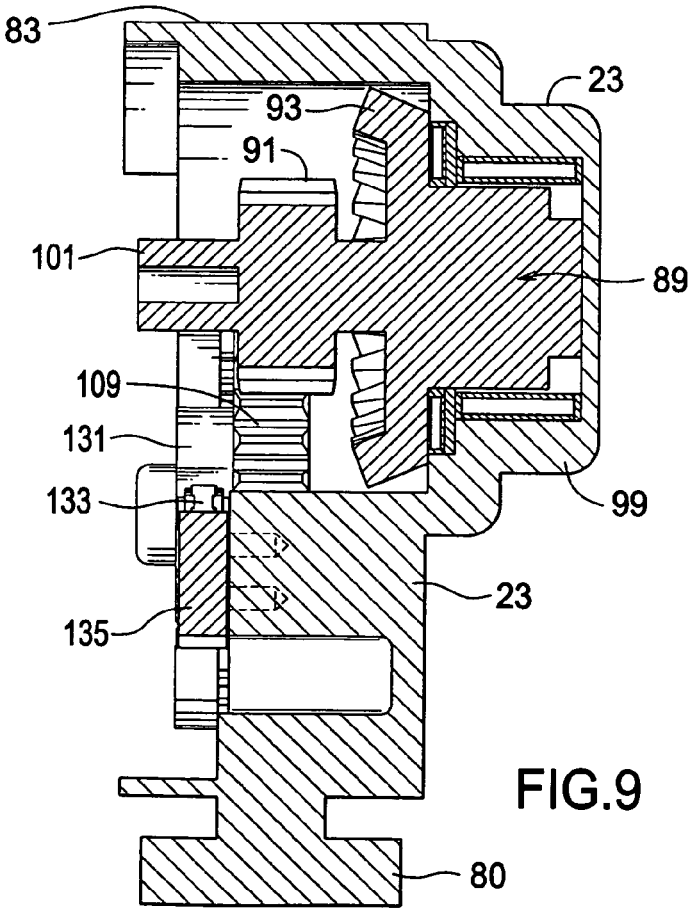
FIG. 9 is a sectional view taken along section lines 9-9 of FIG. 7.
Figure 10:
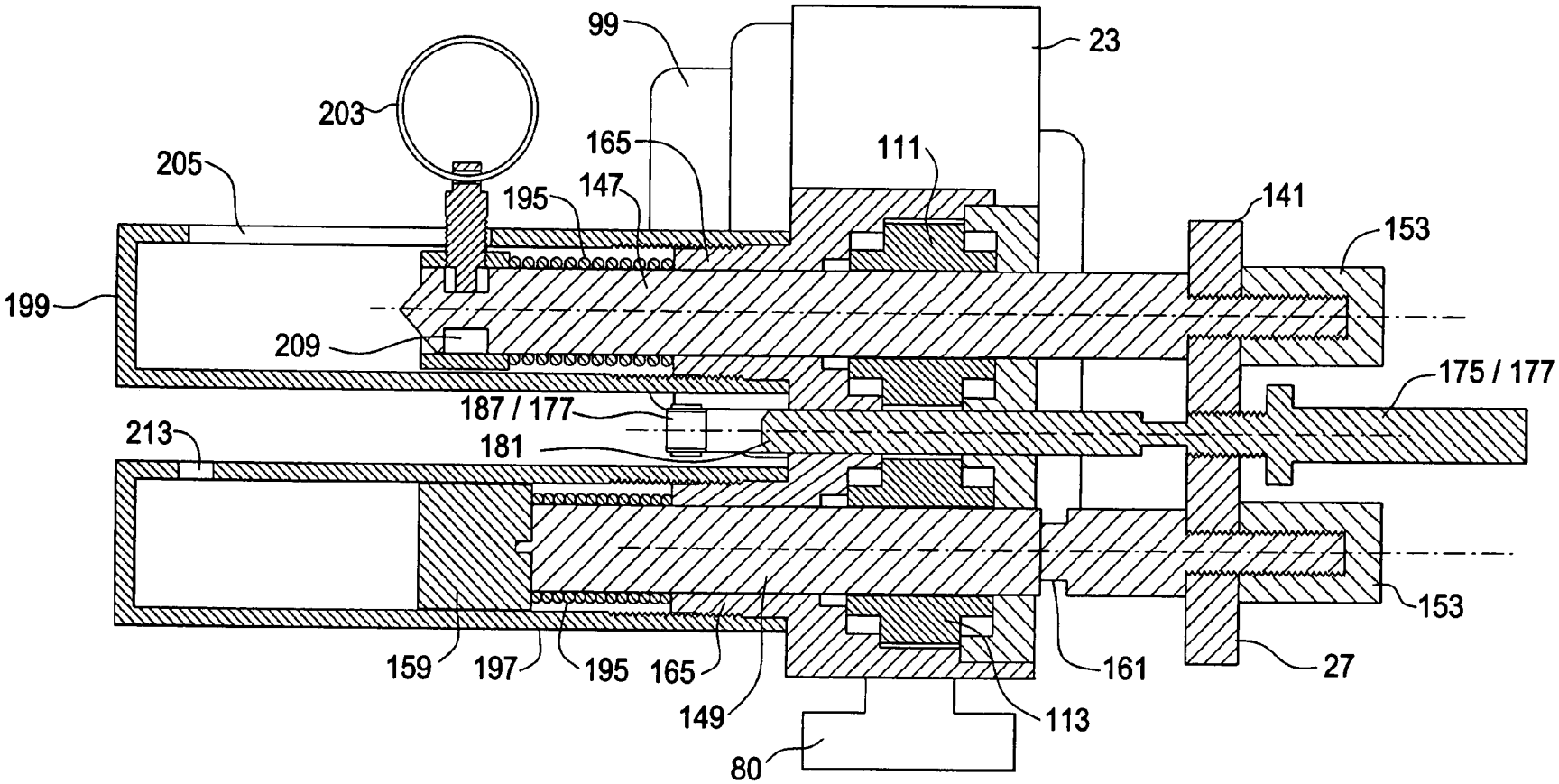
FIG. 10 is a sectional view taken along section lines 10-10 of FIG. 7 but with the top cover and reaction unit in place.

As shown in FIGS. 3 and 4, torque amplification modules 32 and 33 include discrete gear sets in separate housings to accommodate different torque output requirements in different tool configurations. The final output stage 33 includes primary drive output shaft and bevel gear 45 receivable through opening 47 at head 23 (see FIG. 5).

Operational switches, lights and ports are readily accessible, including main on/off switch 51, main operational running switch/trigger 53, forward and reverse jog rocker switch 55 (for advancing or retreating rotation by one to five degree increments), and lights switch 57 (operating white light 59 and red, night light 61). USB port 63 provides communication and data download capabilities (from onboard controller memory) as discussed hereinafter. Control lights 65, 67, 69 and 71 are provided to indicate tool on/off status (yellow—65) and socket status (67—green indicating socket 73 centering at jaw opening 75 and safety switch 77 tripped by placement of a line and fitting 79 (see FIG. 2)). Light 69 blinks (red) at each full rotation of socket 73, and thus a fitting engaged thereat, and light 71 indicates (blue) when the correct connector tightness (nut to fitting body gap, for example) has been achieved.

Housing 29 is preferably a split housing (as shown) held by common fastener techniques, with the housing, when assembled, capturing head 23 at mounting bracket 80. Modules 25, 26, 32 and 33 are affixed to one another and to head 23 utilizing standard screw type fasteners 82.

Turning now to FIGS. 5 through 10, head 23 and reaction unit 27 will be described in greater detail. Head 23 includes main body 83 and top cover 85 held together using screws 87. Gapped jaw 75 is utilized in this embodiment of the driver to accommodate use of a split socket tool 73 (a hex socket, for example) used to manipulate line fittings (79, as shown in FIG. 2). Drive translate assembly 89 includes stacked gears 91 and 93 on shaft 95 and bearing set 97 pressed into main body mounting 99, bevel gear 93 engaged by primary drive output gear 45 of final output stage 33 of torque amplification modules 32 and 33. The opposite end 101 of shaft 95 is rotatably fitted into mount 103 in cover 85.

Drive transfer gear assembly 107, including main drive gear 109 and idler gears 111 and 113, complete the drive train. Main drive gear 109 engages gear 91 of translate assembly 89 and is mounted on shaft 115 of main body 83. Idler gears 111/113 are used in split socket applications, providing constant drive application to socket 73, and are mounted on bearing shoulders 117 in housing detents 119 and cover openings 121. Socket 73 is mounted on bearing shoulder 123 in housing detent 125 and cover opening 127. Main drive gear 109 and socket 73 preferably are the same size and have the same gear tooth count, so that rotation thereof is one to one. Cam surface 131 is provided at gear 109 and follower 133, the roller of roller switch 135, is mounted at main body 83 adjacent thereto using screws 137. This arrangement provides indication of socket 73 rotation at light 69 as well as socket location (in degrees) and rotation counting in onboard controller software or firmware.

Reaction unit 27 includes fitting engagement 141 (gapped for receipt of line fittings as shown in this embodiment) for engaging a utility related to the connector being manipulated (for example, a line fitting body, the second part of a line fitting assembly not including the nut). Engagement 141 in this embodiment, for example, includes a sized slot 143 having surfaces configured to receive and securely hold a hexagonal fitting body. Rail guides 145 and 147 (a single guide could be utilized in some embodiments of the driver of this invention) are received at reduced diameter threaded ends 149 through openings 151 of engagement 141 and are held thereat by cap nuts 153.

Guide 145 includes second reduced diameter end 155 engageable (pressed into) opening 157 of piston 159. Guide 145 also includes intermediate annular slot 161 for capture and retention of reaction unit 27 by clip 163 at cover 85 (during fitting loading, reaction unit 27 must be held in an opened, disengaged position, since, as will be appreciated, the entire unit 27 is spring biased). Guides 145 and 147 are receivable through openings 121 in cover 85, through openings 164 of idler gears 111 and 113, and the openings into body 83 through threaded shoulders 165.

Clip 163 is mounted at the end of spring biased latch body 166 held in latch mount 167 attached to cover 85. Spring 169 is held in mount 167 between body 166 and mount 167 and biases body 166 so that clip 163 is urged toward and across one opening 121 of cover 85 and into engagement with rail guide 145. Release grip 171 protrudes from body 166 allowing user access for movement of latch body 166. Sliding movement of reaction unit 27 on guides 145 and 147 (against unit bias as discussed hereinafter) away from head 23 eventually results in movement of clip 163 into engagement at annular slot 161 thus allowing cocked retention of reaction unit 27 at this position. Once a fitting is correctly positioned at the driver, retraction of latch body 166 using release grip 171 by a user frees clip 163 from slot 161 allowing movement of unit 27 toward head 23 and into correspondence with a connector utility at engagement 141.

Figure 11:
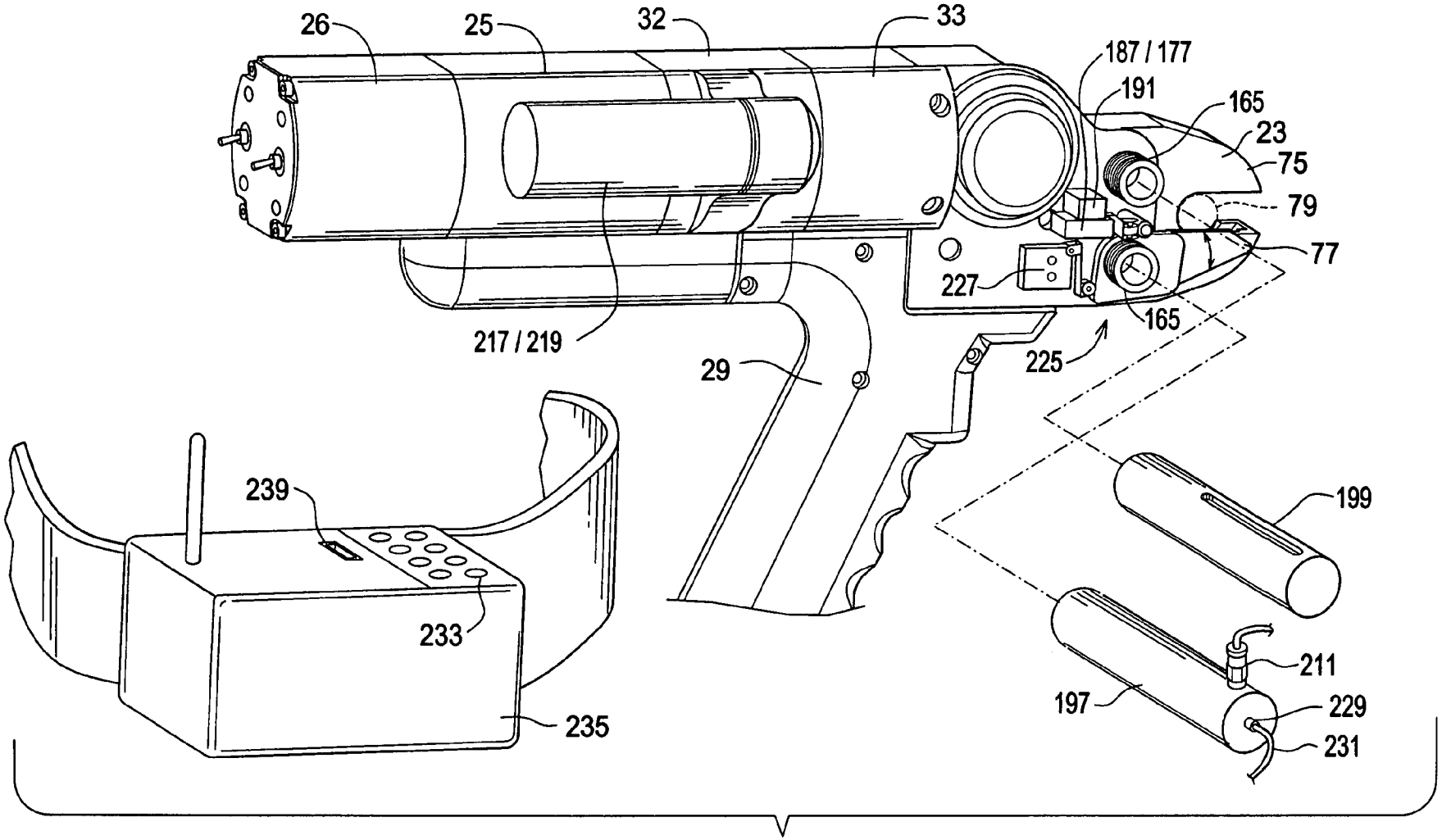
FIG. 11 is a partially exploded perspective view showing additional features which may accompany the driver of this invention.

Probe component 175 of switching assembly 177 is threadably received through opening 179 of engagement 141, probe reach being adjustable by extent of threaded engagement. Probe end 181 is receivable through openings 183 and 185 in cover 85 and body 83, respectively. Switch component 187 of assembly 177 (a roller switch, for example) is attached by screws 189 to a mounting block 191 (as shown in FIG. 11) on body 83 to position the roller of roller switch 187 over opening 185 and thus in the path of probe end 181. Switch component 187 is operatively linked (through controls as shown hereinafter) with the main motor of the driver to decouple motive force when tripped by probe end 181.

Engagement 141 of reaction unit 27 is biased toward driver head 23 (and particularly toward socket 73) by springs 195 in closed ended retainers 197 and 199 threadably engaged at shoulders 165. Springs 195 are maintained between shoulders 165 and piston 159 at retainer 197 and slide 201 at retainer 199 thus biasing the piston and the slide (and so guides 145 and 147 and the rest of reaction unit 27) toward the closed ends of the retainers 197 and 199. Slide 201 is retained at the end of guide 147 by manually releasable spring clip 203 received through slide slot 205, threaded opening 207 in slide 201 and annular slot 209 at guide 147. When spring clip 203 is retracted from slot 209 thus releasing guide 147, reaction unit 27 may be fully withdrawn from head 23.

As may be appreciated, as a fitting nut is tightened on a fitting body using the driver of this invention, engagement 141 of reaction unit 27 in contact with the fitting body is biased toward socket 73 at the same rate as the nut moves toward the fitting body. At the same time, probe end 181 is proceeding at this rate toward switch component 187. By virtue of probe length and/or geometry selection (either factory selected for particular operations, threadably adjustable, or by selection and installation of one of a variety of probe components having different selected lengths for different fitting specifications), switch contact occurs when correct connector or fitting (nut to body gap) tightness is achieved thereby causing cessation of socket rotation. Such operations are highly predictable and thus repeatable. Since most motor and drive trains have overrun (i.e., a few degrees of continued rotation due to system momentum), the driver is programmed with an automatic reverse rotation at the end of the tightening cycle corresponding to estimated system overrun to relieve system tension without changing nut torque. Use of the jogging function can provide further tightening or loosening as desired. After disengagement from a tightened fitting, split socket 73 is run to the gap centered position relative to jaw opening 75 (for example, in a fully automated mode, by a subsequent press of trigger switch 53 after release thereby running socket 73 to the centered position—indicated by light 67—and resetting the driver for a new connector driving cycle).

Reaction unit 27 may be manually reset for a new cycle ("cocked" as described above) or may be reset by pneumatic means as shown herein. Pneumatic fitting 211 is threaded at opening 213 of retainer 197 and connected by line 215 with valve 217 and pressurized gas cylinder 219. After a fitting is tightened, triggering valve 217 causes a burst of gas to enter retainer 197 through opening 213 forcing piston 159 against spring bias to move guide 149 (and thus unit 27, releasing and resetting switch component 187) until slot 161 captures spring biased retaining clip 163.

Figure 12:
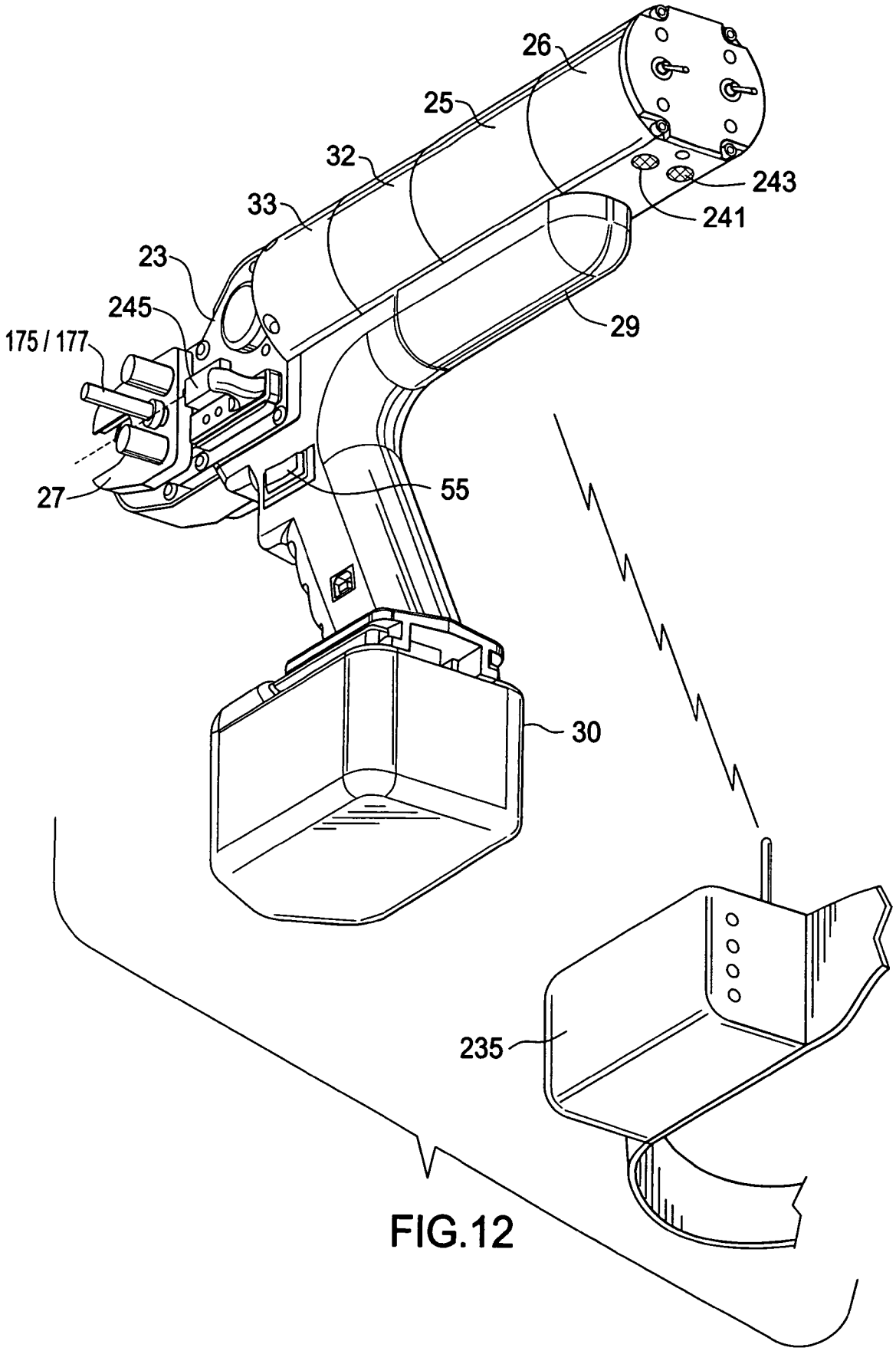
FIG. 12 is a perspective view illustrating still other additional features which may accompany the driver of this invention.

Turning to FIGS. 11 and 12, several additional driver features may be provided to enhance safety and utility. Safety switch assembly 225 includes switch 77 pivotably biased to a position closing gapped jaw 75. When forced open by a line or other fitting 79, switch 77 geometry causes engagement at roller switch 227 attached to head 23 thereby electrically enabling driver operation. A second pneumatic fitting 229 is positioned for access to the interior of retainer 197. Line 231 connected with fitting 229 is received at port 233 of a test fixture 235 to thereby receive continuously aspirated samples from the fitting\connector union area through retainer 197 and bore hole 236 through guide 145 (see FIG. 5). Leak detection at a fitting may thus be accommodated.

Test fixture 235 may be belt mounted, as shown, and may include a USB input 239 (for communication through the USB port at the driver or with a base computer). BLUE TOOTH and/or radio communication may be provided for data download from the driver or upload from a base station. Cellular technology may also be accommodated for the user, with a speaker 241 and microphone 243 positioned at housing 29 or any of the driver modules. Real time video may be provided at video unit 245 (and downloaded or stored with appropriate in-situ memory), allowing remote review of operations and/or a record of completed tasks.

Figure 13:
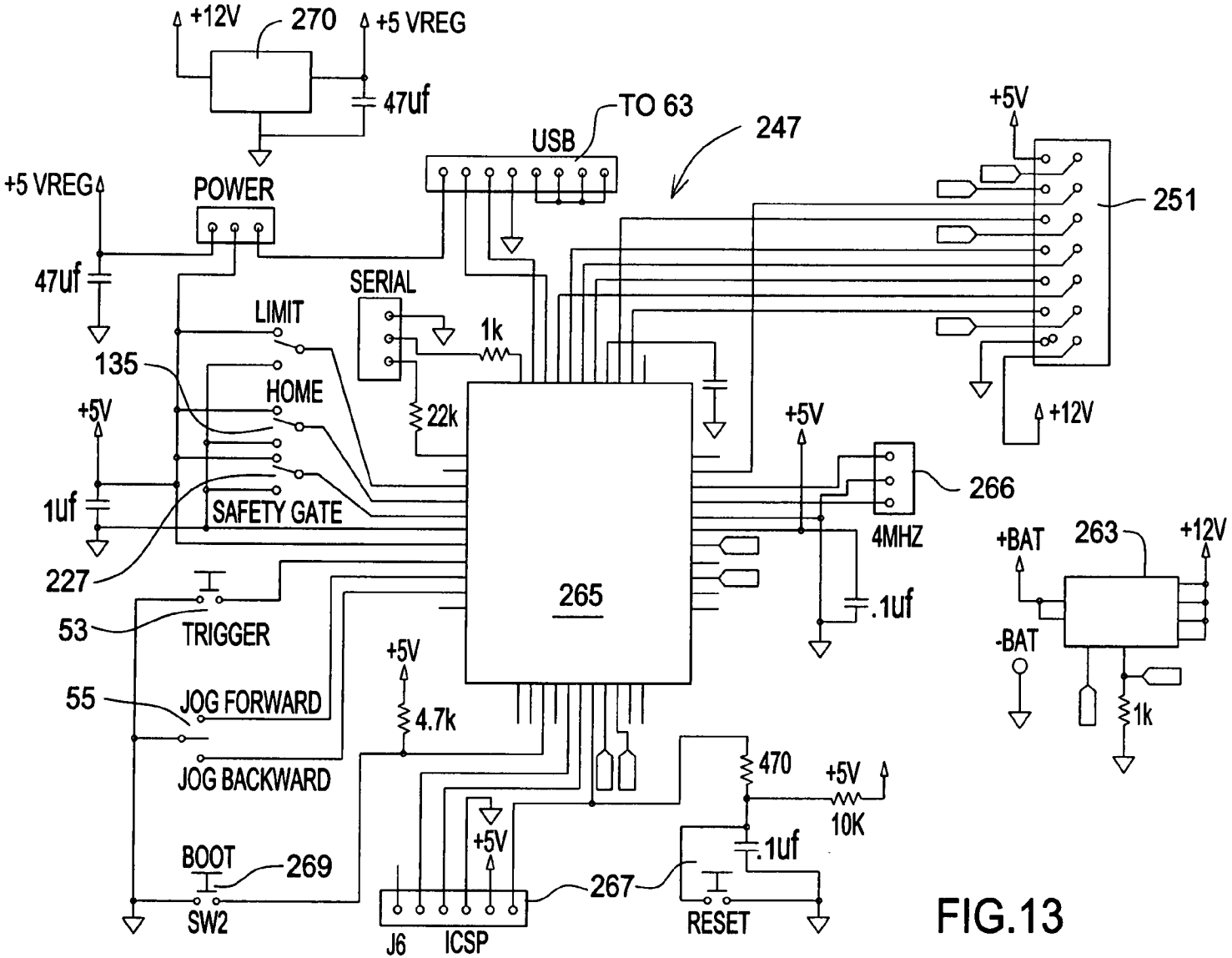
FIGS. 13 through 15 are schematic diagrams showing the electronics of the driver of this invention.
Figure 14:
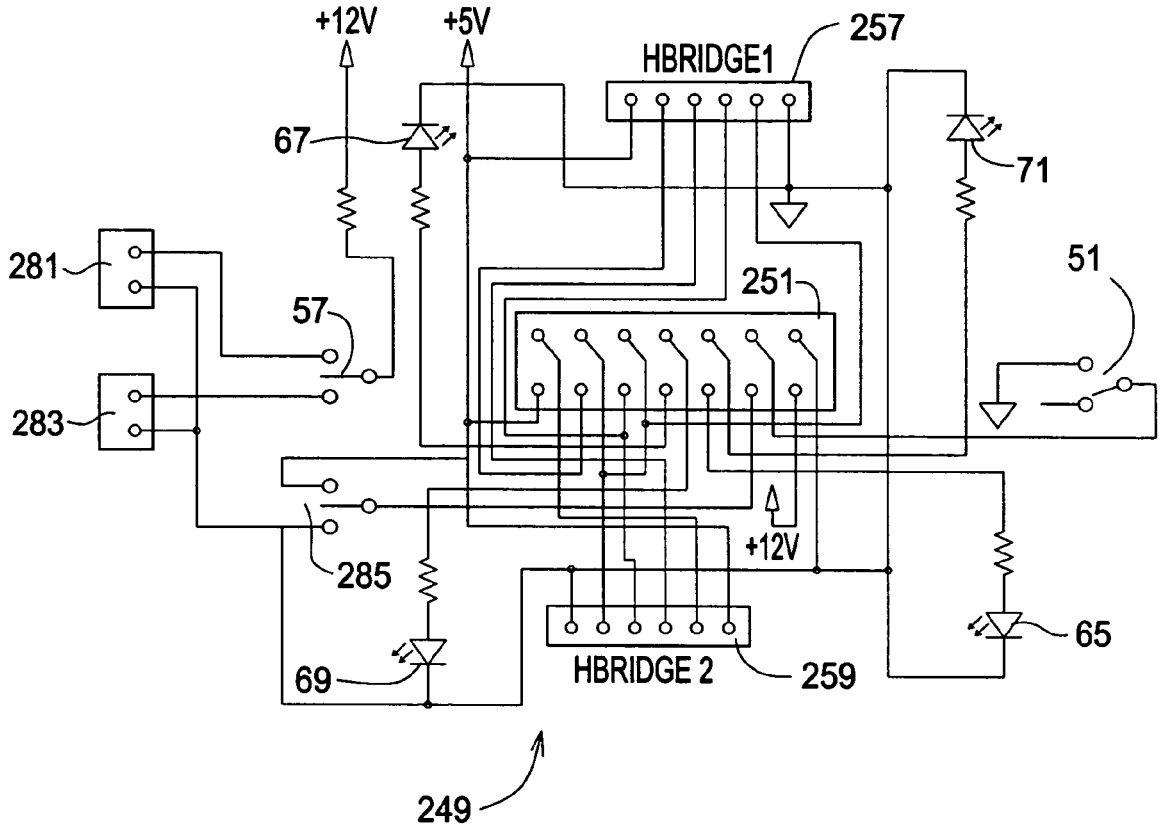
Figure 15:
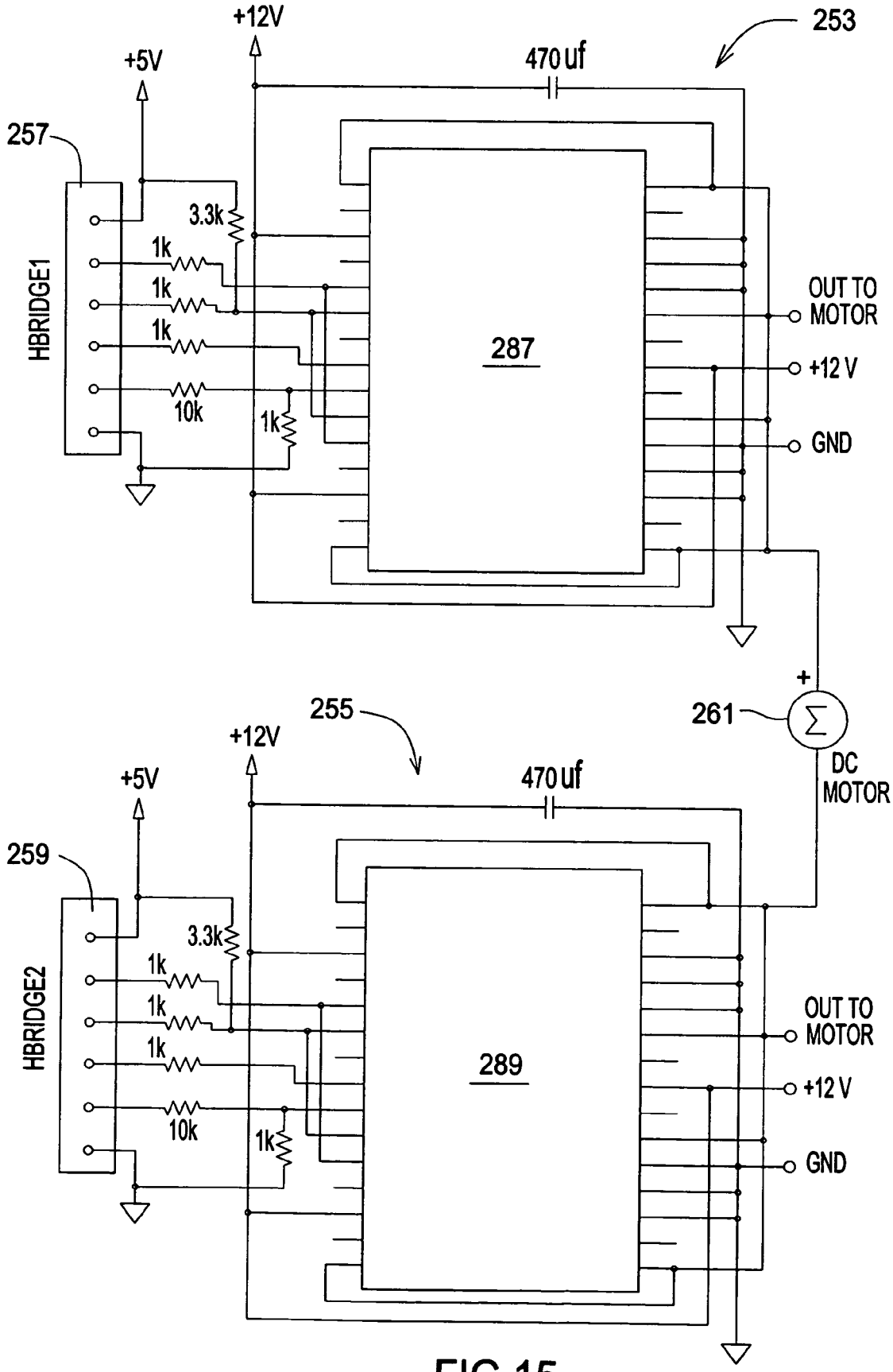

FIGS. 13 through 15 illustrate the electronic implementation of driver 21 of this invention, the boards described hereinafter housed in module 26. Main control board 247 (FIG. 13) is connected with switching board 249 (FIG. 14) at port connectors 251. Board 249 is connected with the two one-half h-bridge circuits 253 and 255 at connectors 257 and 259 (FIG. 15), the h-bridge circuits driving motor 261 (housed at module 25) in a conventional arrangement. Main board 247 includes a smart highside current power switch arrangement 263 (for example, a PROFET BTS660P by INFINEON TECHNOLOGIES) and a Flash USB ready microcontroller 265 (for example, a PIC18F2455/2550/4455/4550 series 28/40/44 pin microprocessor by MICROCHIP TECHNOLOGY, INC.) connected with clock oscillator 266. USB signals are accommodated at the connector to USB port 63.

Programming/reset circuits 267 are provided for programming and troubleshooting with programming switch 269 (modes may include everything from fully manual to fully automated), and voltage regulation is provided by regulator circuit 270. Momentary rocker switch 55 with center off provides for input to controller 265 of jog functions, and trigger switch 53 inputs running commands. Safety gate switch 227 inputs run ready signals, and rotation counter switch 135 inputs socket rotation count/location data.

Connectors 281 and 283 at switching board 249 are connected with lights 61 and 59, respectively, for operations responsive to switch 57 actuation. Switch 285 is a mode selection switch (manual or auto). On/off switch 51 signals are input through, and motor control signals are output through, board 249. H-bridge circuits 253 and 255 include integrated motor drivers 287 and 289, respectively (for example, VNH2SP30-E drivers from ST).

As may be appreciated, this invention provides a highly adaptable driver for precise manipulation of threaded connectors that employs location specific switching to accomplish reliable connector tightening. The gap probing techniques discussed herein (their particular location and the triggering embodiments shown in the FIGURES) are illustrative, it being understood that a variety of probing means and relative positions of switches and triggering related to location specific on/off switching could be utilized. By way of example, switch location could be anywhere along a mechanical probe or at either end, and probing could be conducted mechanically (as shown), electronically, magnetically or optically. Switches, likewise, could be mechanical (as shown) or sensory (optical, magnetic, electronic, etc.), or embodied in software. One particularly useful alternative replaces limit switch 187/177 with a linear resistor to regulate motor speed (to regulate nut to body gap closure speed at different stages of the traversed distance) as well as motor shut off.

What is claimed is:

1. Drive engagement and safety apparatus for a powered connector driver utilized to rotate a threaded fitting, said apparatus comprising:

a driver head receivable at the driver and having a gapped jaw and means for effecting rotation of a split socket maintained therein to selectively rotate the threaded fitting when received in said split socket through said gapped jaw of said driver head; and a safety assembly including a status indicating control light and a biased gate switch pivotably connected at said driver head and biased to a position normally closing access through said gapped jaw, said biased gate switch having a geometry selected so that a fitting presented thereat causes pivoting movement of said gate switch against bias to allow fitting access through said gapped jaw and into said split socket, said control light at least responsive to said biased gate switch for indicating to a user when said gate switch has been pivoted against bias allowing fitting receipt at said split socket.

2. The apparatus of claim 1 wherein the driver includes a controller and user operational controls and wherein said safety assembly further includes a roller switch at said driver head engageable by said gate switch for sending run status electrical signals to said controller dependent on position of said gate switch.

3. The apparatus of claim 1 wherein said control light is responsive to driver operation indicating centering of said split socket at said gapped jaw to allow movement therethrough of the threaded fitting.

4. The apparatus of claim 2 wherein said roller switch is open when said gate switch is at said position closing access through said gapped jaw thereby prohibiting user actuation of the driver using the operational controls.

5. The apparatus of claim 2 wherein said roller switch is closed when said gate switch is pivoted against its bias allowing fitting access through said gapped jaw thereby enabling user actuation of the driver using the operational controls.

6. The apparatus of claim 2 wherein said control light is connected with the controller and responsive to movement of said split socket and the user operational controls for indicating to a user status and operation of the driver.

7. The apparatus of claim 1 wherein said safety assembly further comprises a white light and a night light for operations responsive to a manual switch.

8. Drive engagement and safety apparatus for a powered connector driver having user controls utilized to rotate a threaded fitting, said apparatus comprising:

a driver head receivable at the driver and having a gapped jaw and means for effecting rotation of a split socket maintained therein to selectively rotate the threaded fitting when received in said split socket through said gapped jaw of said driver head, said means for effecting rotation including a drive translate assembly for altering plane of drive rotation relative to the driver; and a safety assembly including a biased first switch and a second switch engageable by said first switch, said first switch pivotably connected at said driver head, biased to a position normally closing access through said gapped jaw and having a geometry selected so that a fitting presented thereat causes pivoting movement of said first switch against bias to allow fitting access through said gapped jaw and into said split socket, said second switch sending run status electrical signals to the driver dependent on position of said first switch.

9. The apparatus of claim 8 wherein said safety assembly includes control lights responsive to the user controls and movement of said split socket and said first switch indicating to a user when the driver may be safely activated and operational status of the driver.

10. The apparatus of claim 8 wherein said geometry of said first switch is selected to cause pivoting of said first switch against bias responsive to fitting pressure applied at one facet thereof and to trip said second switch at another facet thereof when thus pivoted.

11. The apparatus of claim 8 wherein said driver head includes a retainer shoulder defined thereat, said biased first switch pivotable about said shoulder.

12. The apparatus of claim 8 wherein said safety assembly further comprises a white light and a red night light for operations responsive to a one of the user controls.

13. The apparatus of claim 12 wherein said drive translate assembly includes stacked gears one of which is a beveled gear.

14. Control and safety apparatus for a powered connector driver having a driver head with a gapped jaw and means for effecting rotation of a split socket maintained therein to selectively rotate a threaded fitting when received in the split socket through the gapped jaw of the driver head, said apparatus comprising:

operational switches at the driver including a main on/off switch, an operational drive switch, and a jog switch for user advancement or reversal of rotation in small increments, said operational switches connected with a controller; and a safety assembly associated with said controller and including a biased switch pivotably connected at the driver head and biased to a position normally closing access through the gapped jaw, said biased switch having a geometry selected so that a fitting presented thereat causes pivoting movement of said biased switch against bias to allow fitting access through the gapped jaw and into the split socket, user activation of said drive switch being thereby enabled by said controller.

15. The apparatus of claim 14 wherein said safety assembly further includes an enabling switch at the driver head engageable by said biased switch for sending run status electrical signals to said controller dependent on position of said biased switch.

16. The apparatus of claim 14 wherein said safety assembly further includes a status indicating control light associated with said biased switch for indicating to a user when said biased switch has been pivoted allowing fitting receipt at the split socket.

17. The apparatus of claim 16 wherein said safety assembly further includes at least one additional control light indicating one of driver on/off status, rotation status and fitting tightness.

18. The apparatus of claim 14 wherein said operational switches further include a lights switch and wherein said safety assembly further comprises lights for operations responsive to said lights switch.

19. The apparatus of claim 14 further comprising a video unit connected at the driver head and with said controller for real time recording of operations in said field.

* * * * *